US007988381B1

(12) United States Patent
Meyer-Pflug et al.

(10) Patent No.: US 7,988,381 B1
(45) Date of Patent: Aug. 2, 2011

(54) DISABLING APPARATUS FOR ROAD VEHICLES

(75) Inventors: Albert Meyer-Pflug, Stanhope, NJ (US); Victor N. Kokodis, Wharton, NJ (US); Frank Dindl, Newton, NJ (US); Warren G. Reiner, Jr., Morristown, NJ (US); Michael Heayn, Wharton, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 206 days.

(21) Appl. No.: 12/206,872

(22) Filed: Sep. 9, 2008

Related U.S. Application Data

(60) Provisional application No. 60/993,102, filed on Sep. 10, 2007.

(51) Int. Cl.
*E01F 13/12* (2006.01)

(52) U.S. Cl. ..... 404/6

(58) Field of Classification Search ..... 404/6, 9; 180/287, 762
See application file for complete search history.

(56) References Cited

U.S. PATENT DOCUMENTS

| | | | | |
|---|---|---|---|---|
| 1,276,400 | A * | 8/1918 | Niznik | 102/370 |
| 5,536,109 | A * | 7/1996 | Lowndes | 404/6 |
| RE35,373 | E * | 11/1996 | Kilgrow et al. | 404/6 |
| 5,904,443 | A * | 5/1999 | Soleau | 404/6 |
| 6,048,128 | A * | 4/2000 | Jones et al. | 404/6 |
| 6,312,189 | B1 * | 11/2001 | Marphetia | 404/6 |
| 6,527,475 | B1 * | 3/2003 | Lowrie | 404/6 |
| 7,037,032 | B1 * | 5/2006 | Marphetia | 404/6 |
| 7,201,531 | B2 * | 4/2007 | Shackelford et al. | 404/6 |
| 7,275,889 | B1 * | 10/2007 | McGill | 404/6 |

FOREIGN PATENT DOCUMENTS

GB 2183702 A * 6/1987

* cited by examiner

*Primary Examiner* — Raymond W Addie
(74) *Attorney, Agent, or Firm* — John F. Moran

(57) ABSTRACT

A vehicle disabling apparatus may include at least one plunger assembly having a plunger and a toggle operable to pivot inside the vehicle tire. The apparatus may include energetic material disposed adjacent the plunger and configured to force the plunger into a vehicle tire. A method of disabling a vehicle having a tire may include using the vehicle's tire to move the plunger and thereby activate the energetic material; and moving the plunger into the tire using gas produced by the energetic material.

19 Claims, 10 Drawing Sheets

DISABLING APPARATUS FOR ROAD VEHICLES

CROSS-REFERENCE TO RELATED APPLICATIONS

This application claims the benefit under 35 USC 119(e) of U.S. provisional patent application No. 60/993,102 filed Sep. 10, 2007, which application is hereby incorporated by reference.

STATEMENT OF GOVERNMENT INTEREST

The inventions described herein may be manufactured, used and licensed by or for the U.S. Government for U.S. Government purposes.

BACKGROUND OF THE INVENTION

The invention relates, in general, to devices for disabling road vehicles, and, in particular, to devices that puncture tires of road vehicles.

Law enforcement personnel are often required to halt fleeing vehicles, and military and security personnel are often required to stop unauthorized vehicles from entering secure areas. It is desirable in these circumstances to slow the vehicle by partially or completely disabling the vehicle. A conventional method of disabling the vehicle is to deflate the vehicle's tires. Although frequently done, it has been found that firing weapons at the tires of fleeing or approaching vehicles tires is inefficient and presents an unacceptable risk of injury to law enforcement/security/military personnel or bystanders.

A number of devices have been developed to serve as partial or complete barricades. Other devices may be deployed across roadways to puncture a vehicle's pneumatic tires as the vehicle passes over the device. Examples of conventional devices are shown in U.S. Pat. No. 3,652,059, issued to Groblebe, on Mar. 28, 1972; U.S. Pat. No. 4,382,714, issued to Hutchison, on May 10, 1983; U.S. Pat. No. 4,995,756, issued to Kilgrow et al., on Feb. 26, 1991; U.S. Pat. No. 5,253,950, issued to Kilgrow et al., on Oct. 19, 1993 (and reissue U.S. Pat. No. Re. 35,373 issued on Nov. 5, 1996); U.S. Pat. No. 5,482,397, issued to Soleau, on Jan. 9, 1996; U.S. Pat. No. 5,536,109, issued to Lowndes, on Jul. 16, 1996; U.S. Pat. No. 5,611,408, issued to Abukhader, on Mar. 18, 1997; U.S. Pat. No. 5,775,832, issued to Kilgrow, et al., on Jul. 7, 1998; U.S. Pat. No. 5,820,293, issued to Groen et al., on Oct. 13, 1998; and U.S. Pat. No. 5,839,849, issued to Pacholok et al., on Nov. 24, 1998.

The conventional devices may deflate the tires of a fleeing vehicle. However, the conventional devices have numerous disadvantages. Conventional tire deflation devices are bulky in size and, accordingly, are inherently cumbersome to deploy, store, operate, and maintain. Conventional tire deflation devices are awkward to handle and often difficult to quickly or surreptitiously move.

More importantly, although the conventional tire deflation devices may deflate tires, they also allow vehicles to continue traveling on the deflated tires. The failure to halt the travel of vehicles is a serious and potentially catastrophic disadvantage in many high security and combat situations. For example, when military personnel are attempting to halt a suicide car bomber's approach to a checkpoint, deflating the tires merely slows the vehicle down and allows the vehicle to continue traveling on the deflated tires. It is crucial in such situations to completely halt the vehicle to prevent the suicide car bomber from reaching his/her target.

SUMMARY OF THE INVENTION

It is an object of the invention to provide a device that may be easily deployed across a roadway.

It is another object of the invention to provide a device for deflating the tires and halting the travel of a moving vehicle.

One aspect of the invention is a vehicle disabling apparatus comprising at least one plunger assembly including a plunger and a toggle operable to pivot inside a vehicle tire. The apparatus may further comprise energetic material disposed adjacent the plunger and configured to force the plunger into the vehicle tire. The at least one plunger assembly may include a case and a cap wherein the plunger is disposed in one end of the case and the cap is disposed in another end of the case.

The apparatus may further comprise a plurality of plunger assemblies fixed to a base that includes top and bottom strips.

Another aspect of the invention is a method of disabling a vehicle having a tire, the method comprising providing the apparatus described above, and pivoting the toggle inside the tire. The method may further comprise using the tire to move the plunger and thereby activate the energetic material; and moving the plunger into the tire using gas produced by the energetic material.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

The present invention includes a tire-deflating and drive train entanglement apparatus for stopping a vehicle. The apparatus may be positioned across a roadway. The apparatus includes one or more spike-tipped plungers that initiate energetic material when compressed by a tire of a vehicle. The expanding gases produced by the energetic material force one or more of the spike-tipped plungers into the tire. When the plunger has penetrated deep enough into the vehicle tire, a toggle on the plunger pivots inside of the tire and prevents the plunger from withdrawing from the punctured tire. The entire apparatus is then pulled into the vehicle's drive train by further movement of the vehicle. The apparatus may deflate one or more vehicle tires and may become entangled with the vehicle drive train, thereby halting the vehicle.

Figure 1:
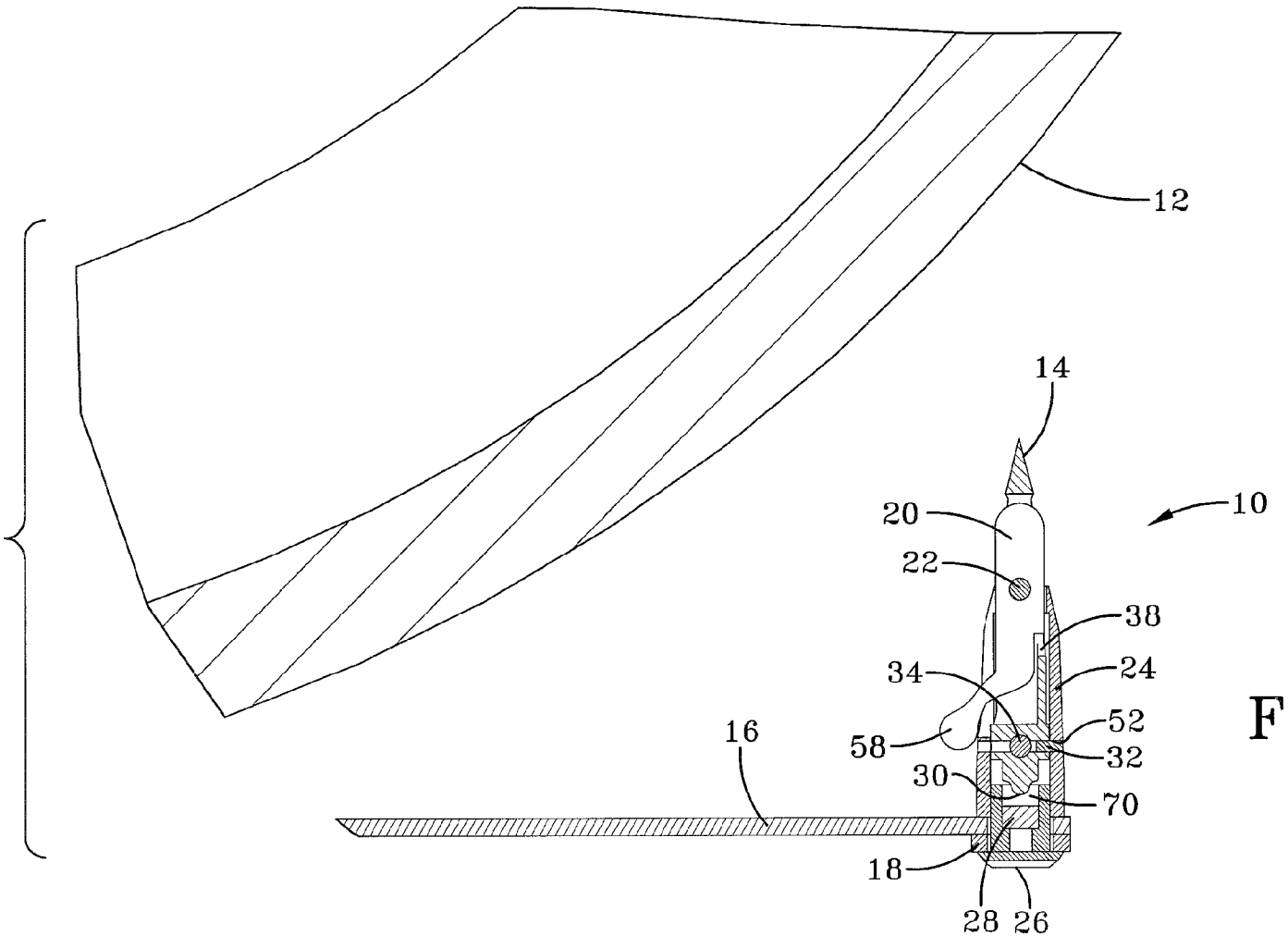
FIG. 1 is a sectional view of one embodiment of a plunger assembly prior to contact with a vehicle tire.

FIG. 1 is a sectional view of one embodiment of a plunger assembly 10 prior to contact with a vehicle tire 12. Plunger assembly 10 may be mounted, for example, on top and bottom strips 16, 18, described in more detail below. Plunger assembly 10 may include a plunger 38, a case 24, a toggle 20, a toggle pivot pin 22, a cap 26, energetic material 28, a shear pin 32 and a stop pin 34.

Figures 5A, 5B, 5C, 5D, 6:
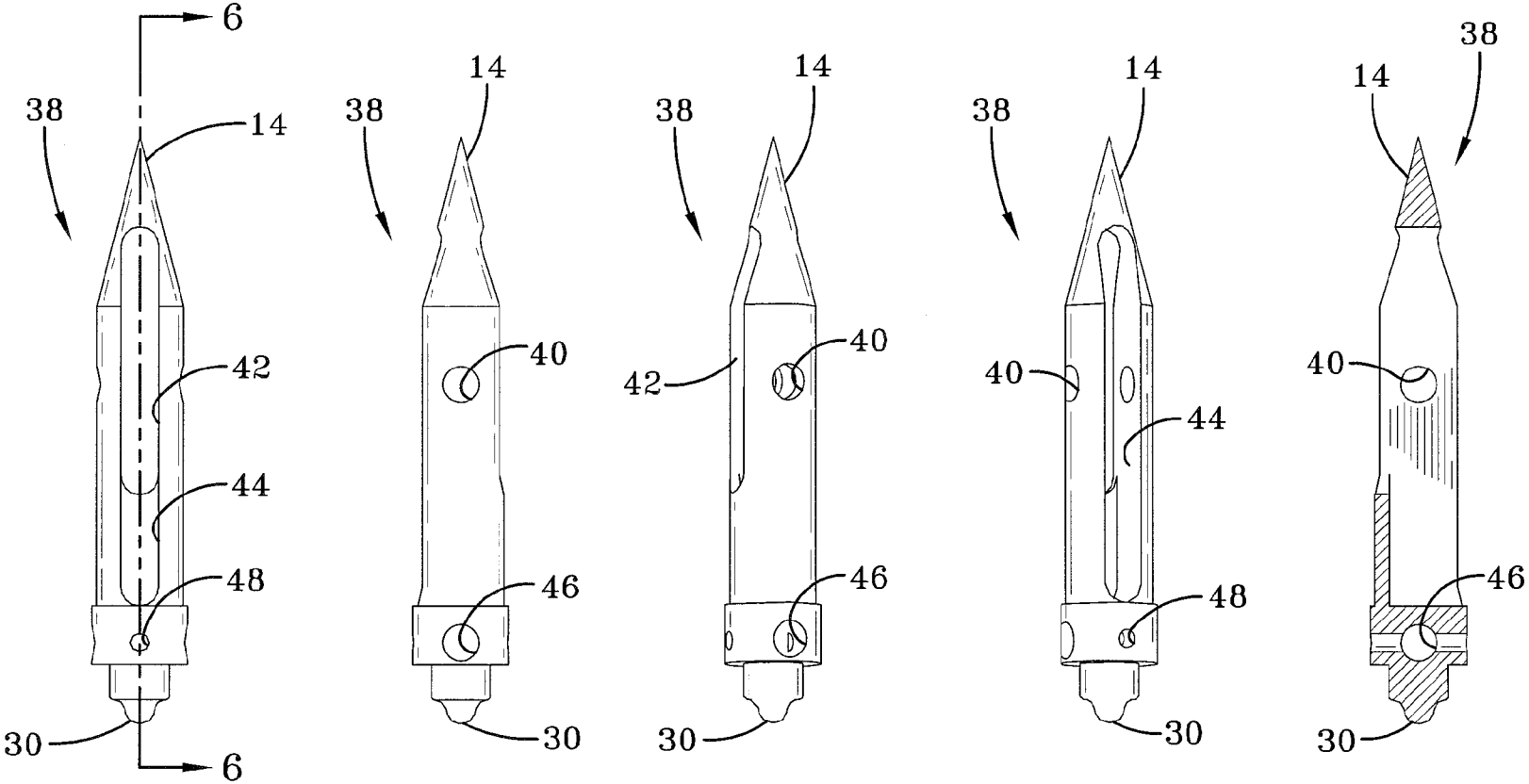
FIGS. 5A, B, C, and D are front (viewing FIG. 1 from the left side), side and two perspective views, respectively, of the plunger of FIG. 1.
FIG. 6 is a sectional view of the plunger, along the line 6-6 of FIG. 5A.

Plunger 38 is shown in detail in FIGS. 5A-D and FIG. 6. FIGS. 5A, B, C, and D are front (viewing FIG. 1 from the left side), side and two perspective views, respectively, of plunger 38 and FIG. 6 is a sectional view of the plunger 38, along the line 6-6 of FIG. 5A. One end of plunger 38 may include a spiked tip 14 and the other end of the plunger 38 may include a protrusion 30, which may function as a firing pin. An opening 40 may be formed in the upper portion of plunger 38 for receiving a pivot pin 22 for mounting toggle 20 (FIG. 1). Plunger 38 may include first and second slots 42, 44, in which the toggle 20 may be rotatably mounted. Two holes 46, 48 may be formed in a bottom portion of plunger 38. Hole 48 may have a smaller diameter than hole 46, and receives a shear pin 32 (FIG. 1). Hole 46 receives a stop pin 34 (FIG. 1).

Figures 7A, 7B, 7C, 7D, 7E, 8:
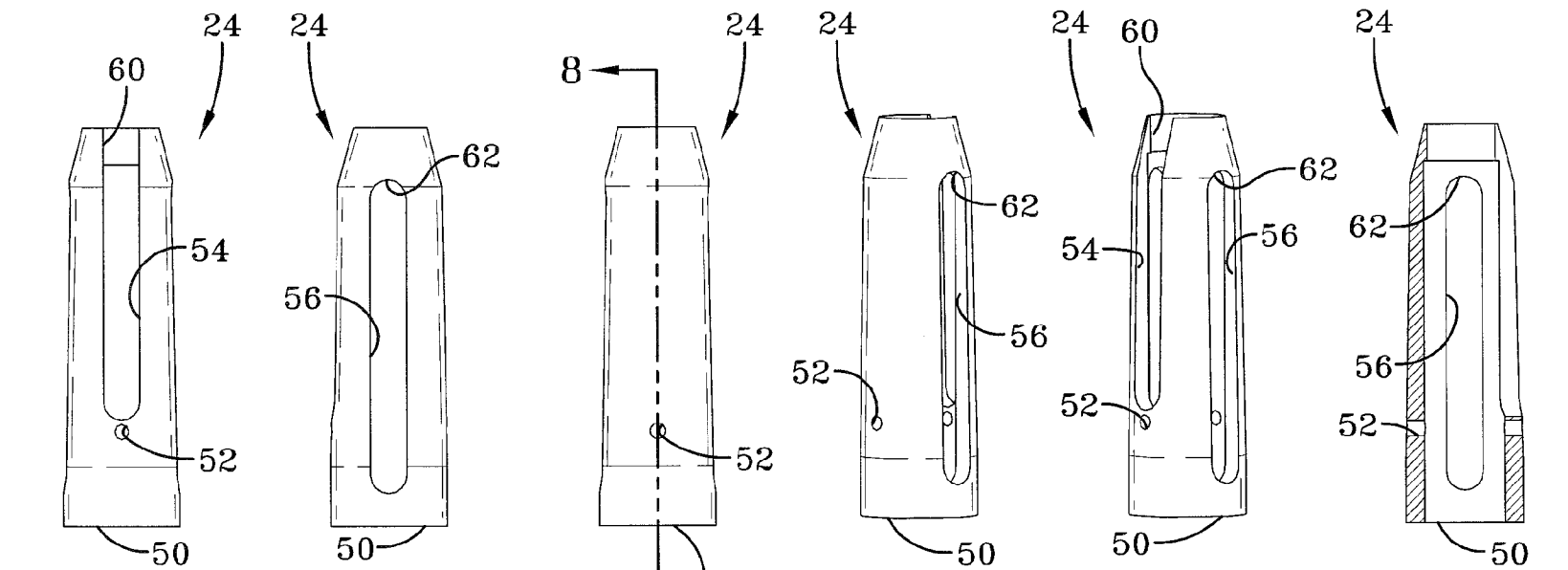
FIGS. 7A, B, C, D, and E are front (viewing FIG. 1 from the left side), side, rear, and two perspective views, respectively, of the case of FIG. 1.
FIG. 8 is a sectional view of the case, along the line 8-8 of FIG. 7.

Case 24 is shown in detail in FIGS. 7A-E and FIG. 8. FIGS. 7A, B, C, D, and F are front (viewing FIG. 1 from the left side), side, rear, and two perspective views, respectively, of the case 24 of FIG. 1. FIG. 8 is a sectional view of the case 24, along the line 8-8 of FIG. 7. A bottom 50 of case 24 may rest on the top of top strip 16 (FIG. 1). An opening 52 may be formed in case 24 for receiving a shear pin 32 (FIG. 1). Case 24 may include first and second slots 54, 56. First slot 54 may be open at a top portion 60 and may allow the arm 58 of the toggle 20 to move upward and out of the case 24. Second slot 56 may be closed at a top portion 62 and may provide a stop for stop pin 34 (FIG. 1). Closed top portion 62 of slot 56 engages stop pin 34 fixed to plunger 38 and prevents plunger 38 from completely exiting case 24 as plunger 38 moves upward.

Figure 10:
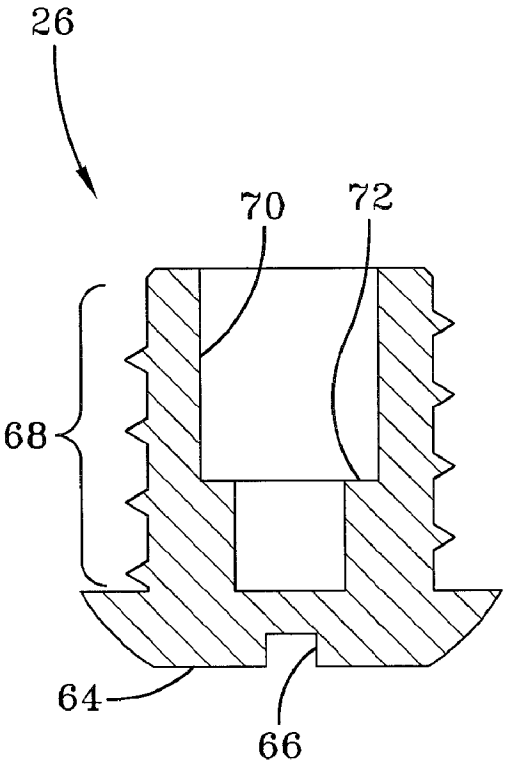
FIG. 10 is a sectional view of the cap, along the line 10-10 of FIG. 9A.
Figure 9B:
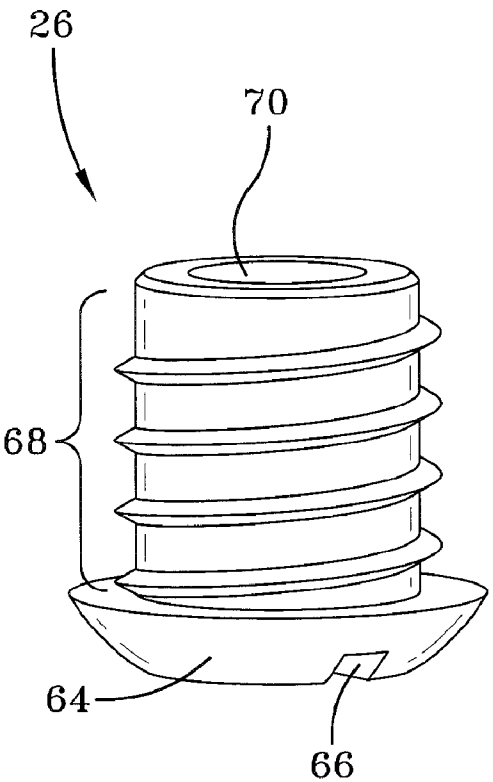
FIGS. 9A and B are front and perspective views, respectively, of the cap of FIG. 1.
Figure 9A:
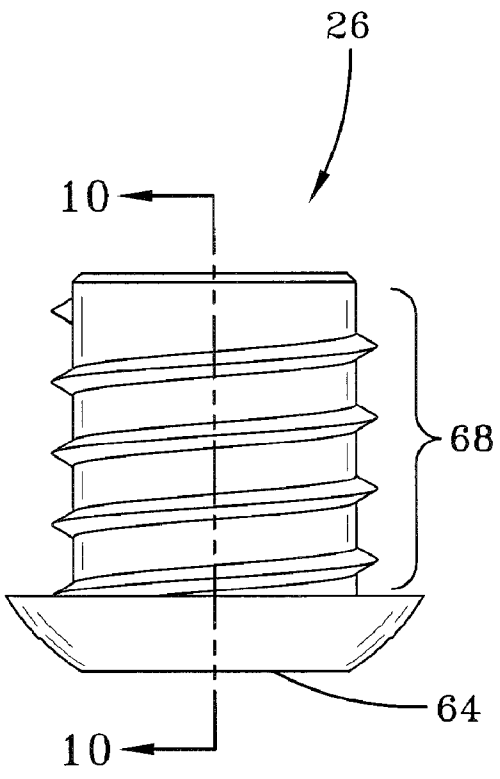
Figure 13:
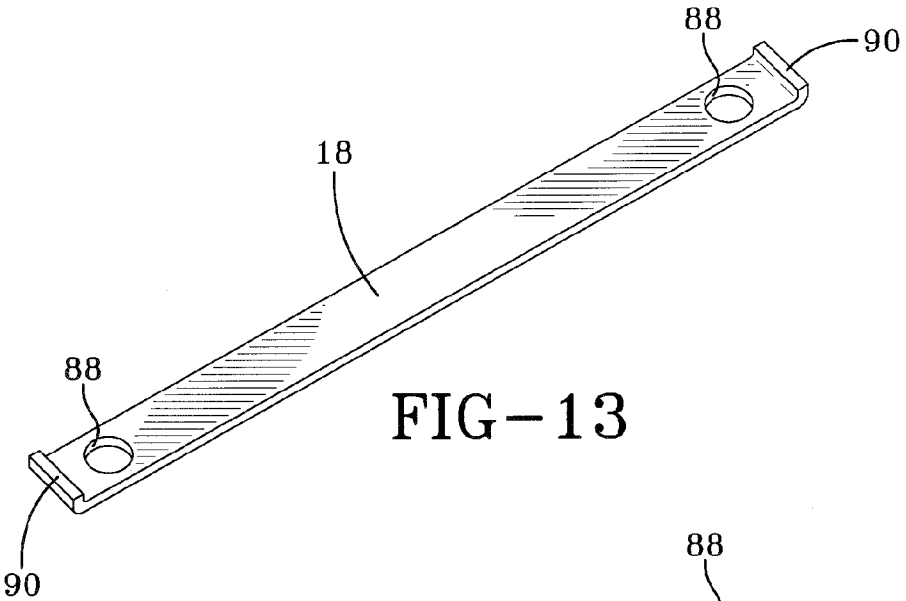
FIG. 13 is a perspective view of a bottom strip.

Cap 26 is shown in detail in FIGS. 9A-B and FIG. 10. FIGS. 9A and 13 are front and perspective views, respectively, of the cap 26 of FIG. 1. FIG. 10 is a sectional view of the cap 26, along the line 10-10 of FIG. 9A. Cap 26 may include a head 64 having a slot 66 formed therein for engaging, for example, a screw driver. Cap 26 may include an externally threaded portion 68 that engages internal threads formed on an interior of the bottom of case 24. Cap 26 may include an opening 70 therein. Opening 70 may include a shoulder 72. As seen in FIG. 1, energetic material 28, for example a primer, may be placed in the opening 70 in cap 26.

Figure 4:
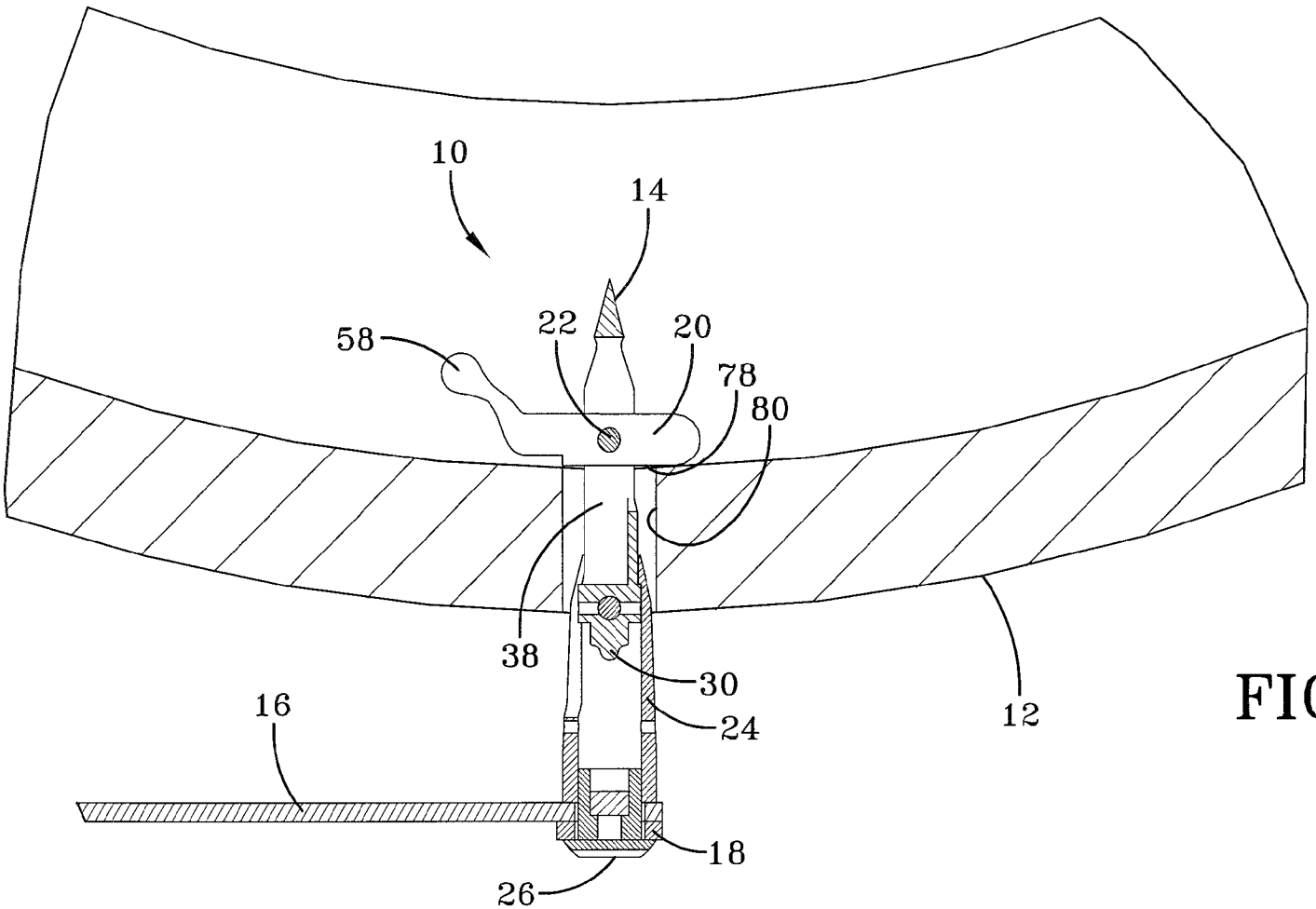
FIG. 4 is a sectional view of the plunger assembly of FIG. 1, with the toggle in an open position inside a tire.
Figure 11C:
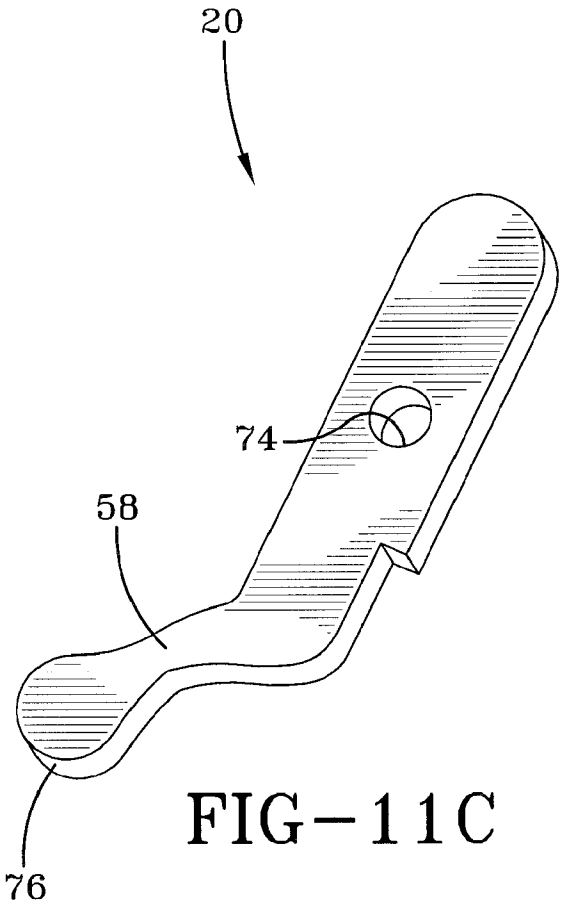
FIGS. 11A, B, and C are front, side and perspective views, respectively, of the toggle of FIG. 1.
Figure 11B:
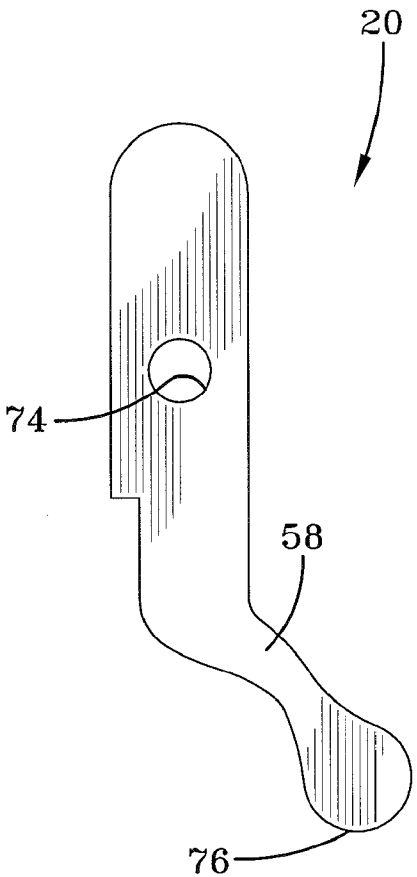
Figure 11A:
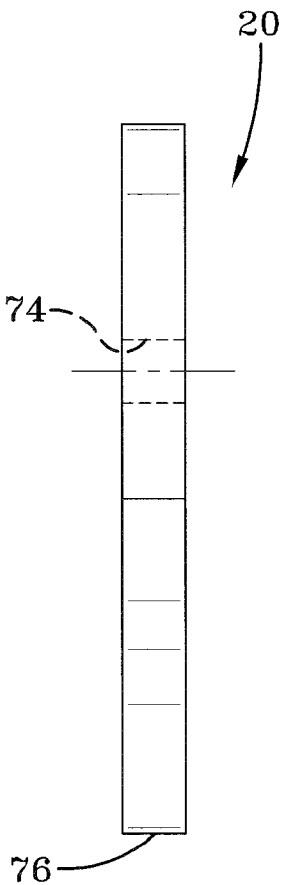

Toggle 20 is shown in detail in FIGS. 11A-C. FIGS. 11A, B, and C are front, side and perspective views, respectively, of the toggle 20 of FIG. 1. Toggle 20 may include an opening 74 for receiving toggle pivot pin 22 (FIG. 1). A bottom surface 76 of toggle arm 58 of toggle 20 may be rounded so that when surface 76 bears against the inside surface of a tire 12, arm 58 will slide across the interior tire surface and cause the toggle 20 to rotate about pivot pin 22, as shown in FIG. 4. Rotation of the toggle 20 may prevent the plunger 38 from being pulled out of tire 12.

Referring now to FIGS. 1-4, FIG. 1 shows plunger assembly 10 prior to contact with tire 12. Energetic material 28 may be disposed in opening 70 in cap 26. Cap 26 may fit through openings (described below) in top and bottom strips 16, 18, and may thread into bottom of case 24, thereby securing the plunger assembly 10 to the strips 16, 18. A shear pin 32 may be disposed in opening 52 in case 24 and opening 46 (FIG. 5B) in plunger 38. Stop pin 34 may be disposed in opening 48 (FIG. 5A) in plunger 38 and in slot 56 (FIG. 7B) in case 24. Toggle 20 may be rotatably fixed to plunger 38 using pivot pin 22.

Figure 2:
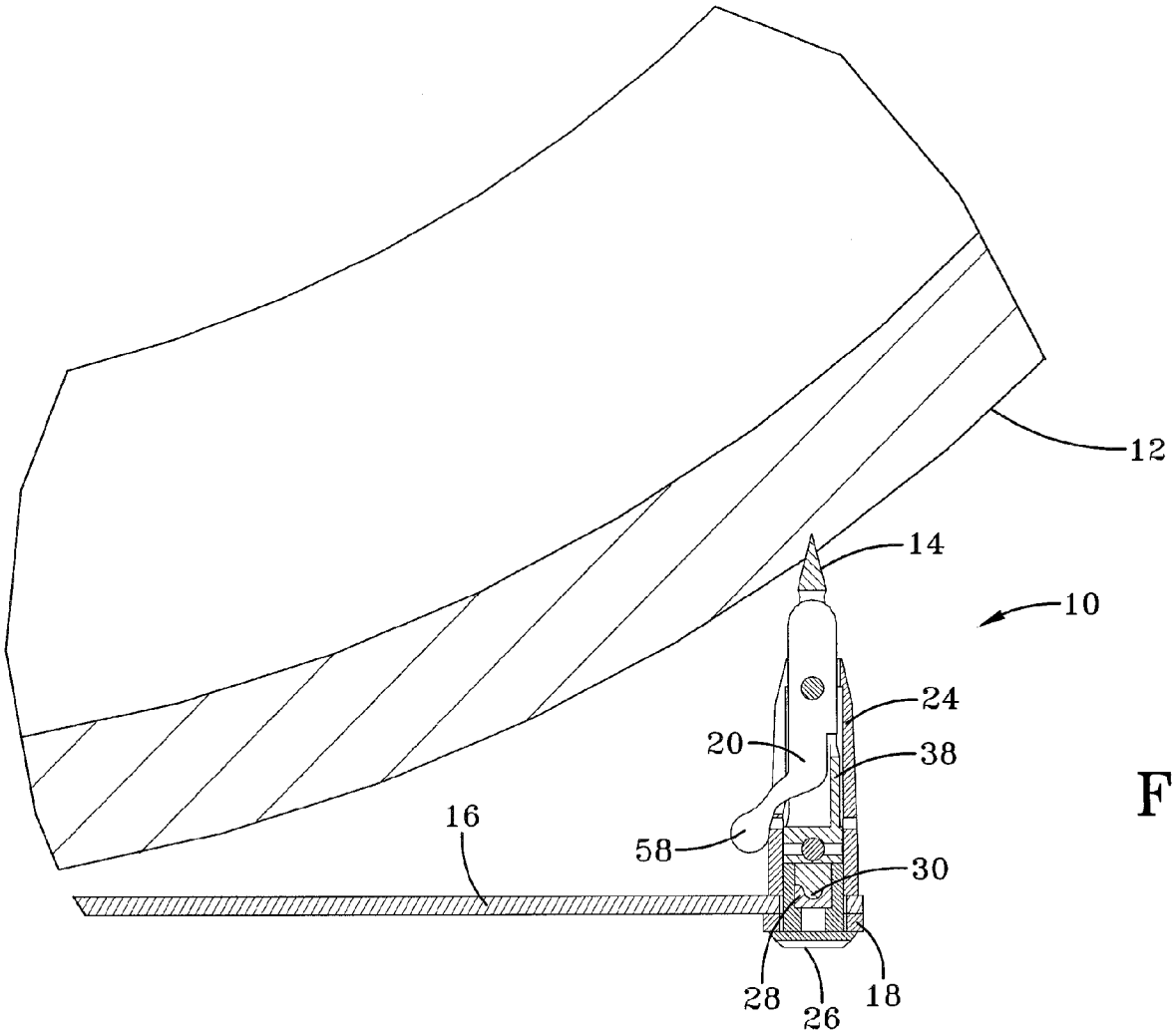
FIG. 2 is a sectional view of the plunger assembly of FIG. 1, after being compressed by contact with a vehicle tire.

FIG. 2 is a sectional view of the plunger assembly 10 of FIG. 1, after being compressed by contact with a vehicle tire 12. Contact of tire 12 with spiked tip 14 may force the plunger 38 downward, which may cause shear pin 32 (FIG. 1) to break. Protrusion 30 on the bottom of plunger 38 may contact energetic material 28 and activate energetic material 28.

Figure 3:
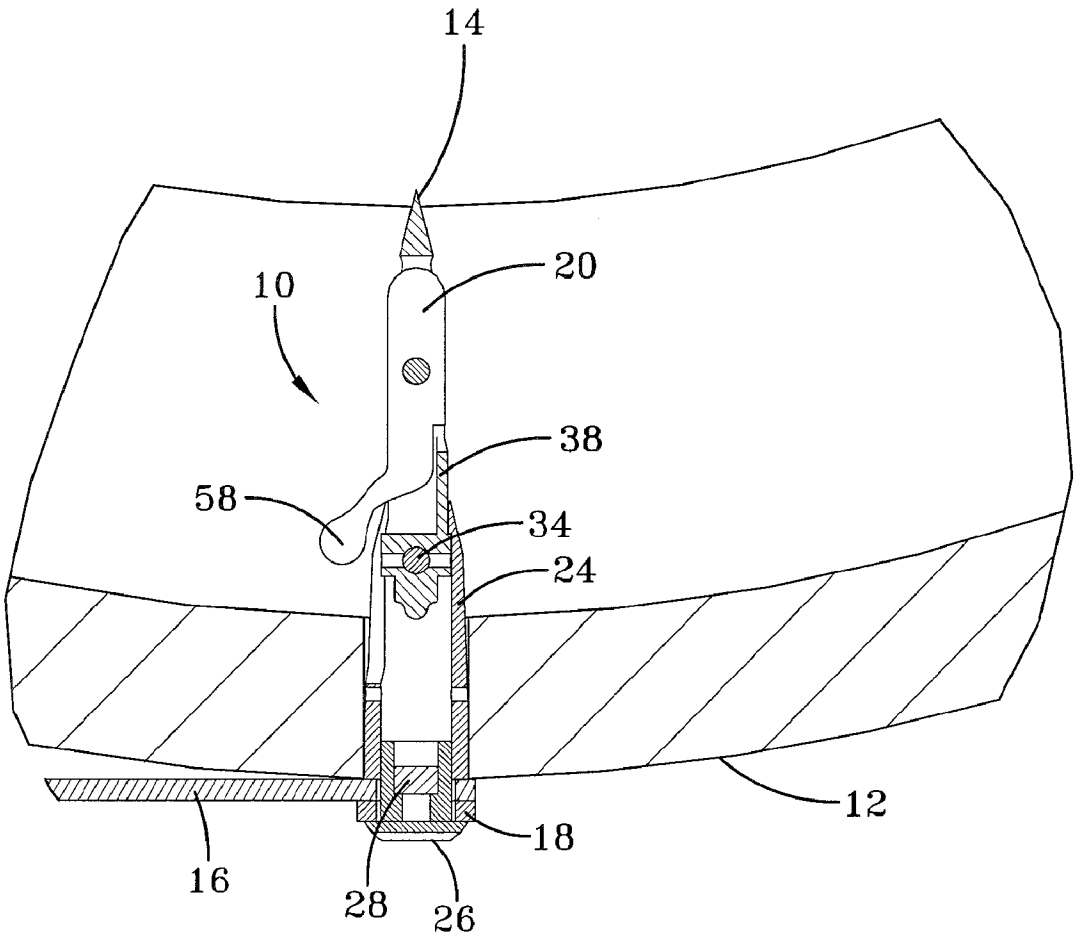
FIG. 3 is a sectional view of the plunger assembly of FIG. 1, after activation of the energetic material.

FIG. 3 is a sectional view of the plunger assembly 10 of FIG. 1, after activation of the energetic material 28. Gases produced by the energetic material 28 may force the plunger 38 to move upward into tire 12. Upward movement of plunger 38 may be limited by stop pin 34 that bears against the top of slot 56 (FIG. 7B) in case 24. As tire 12 continues to rotate, plunger 38 may tend to retract or pull out of tire 12.

FIG. 4 is a sectional view of the plunger assembly 10 of FIG. 1, with the toggle 20 in an open position inside a tire 12. As the plunger 38 retracts, the toggle arm 58 may contact the inside of the tire 12 and may cause the toggle 20 to rotate about pivot pin 22. Rotation of the toggle 20 may cause the surface 78 of toggle 20 to contact the tire interior. Because the surface 78 of toggle 20 may be larger than the opening 80 in tire 12, the plunger 38 may be prevented from retracting from tire 12. Thus, tire 12 may begin to deflate. In addition, as the vehicle continues movement and tire 12 continues to rotate, the remainder of the apparatus 82 (FIG. 12), which may include a plurality of linked top and bottom strips 16, 18 and a plurality of plunger assemblies 10, may be pulled around the vehicle's axle and into the vehicle's drive train. By entangling the vehicle's tires, axles, and drive train with the disabling apparatus, the vehicle may be halted well before tire 12 is completely deflated.

Figure 12:
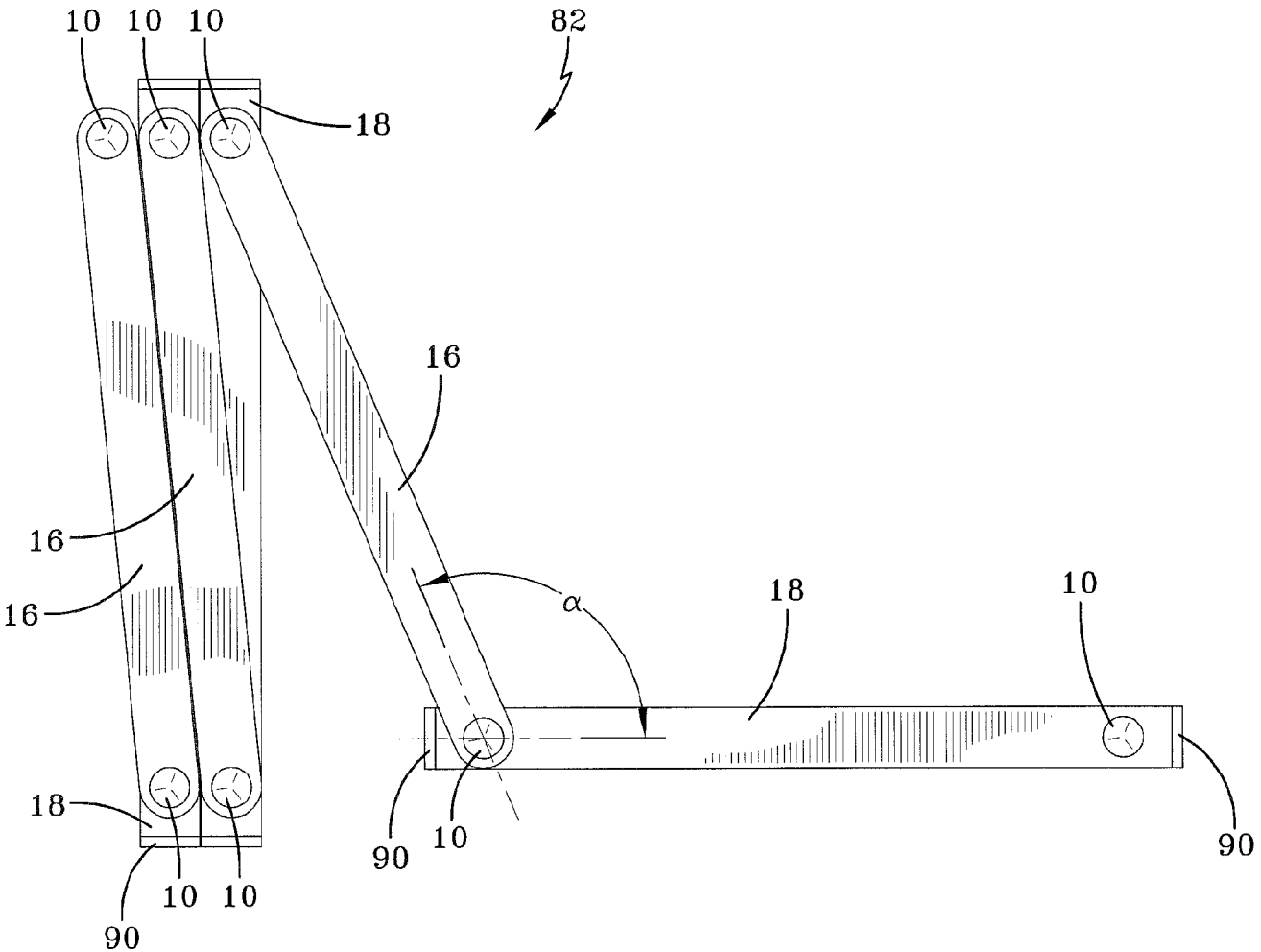
FIG. 12 is a top view of one embodiment of a vehicle disabling apparatus.
Figure 14:
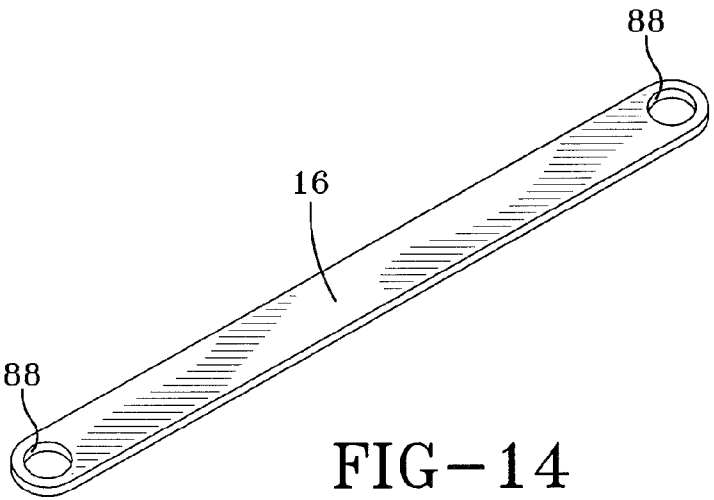
FIG. 14 is a perspective view of a top strip.

A disabling apparatus for road vehicles may include a plurality of plunger assemblies 10 mounted on a base or support member. A top view of one embodiment of a disabling apparatus 82 is shown in FIG. 12. Apparatus 82 may include a plurality of plunger assemblies 10 that may rotatably join a plurality of bottom strips 18 to respective top strips 16. Top and bottom strips 16, 18 may include openings 88 (FIGS. 14 and 13) for receiving the plunger assemblies 10. The bottom 50 (FIG. 1) of case 24 may rest on top strip 16. Cap 26 (FIG. 1) may be inserted through opening 88 in bottom strip 18 and opening 88 in top strip 16 and then threaded into the bottom of case 24.

To prevent the apparatus 82 from unfolding into a straight line, appropriate stop members 90 (FIGS. 12 and 13) may be provided on bottom strip 18. As shown in FIG. 13, stop members 90 may comprise a raised portion at ends of bottom strip 18. The maximum angle alpha (FIG. 12) between a top and bottom strip 16, 18 may be adjusted in various ways, for example, by moving the location of openings 88 or stop member 90. By way of example only, top and bottom strips 16, 18 may be about 7 inches long, about 0.6 inches wide, and about 0.1 inch thick. In FIG. 12, an exemplary angle alpha may be about 113 degrees.

Additional plunger assemblies 10 may be provided at locations on strips 16, 18 other than those shown in the Figs. In addition, the strips 16, 18 may be connected via openings 88 using fasteners, such as bolts and nuts, rather than using the plunger assemblies 10. In that case, the plunger assemblies 10 may be located on the strips 16, 18 between the openings 88.

A variety of materials may be appropriate for manufacturing the components of apparatus 82. By way of example only, the top and bottoms strips 16, 18, plunger 38, case 24, cap 26, and toggle 20 may be made of steel.

Figure 15:
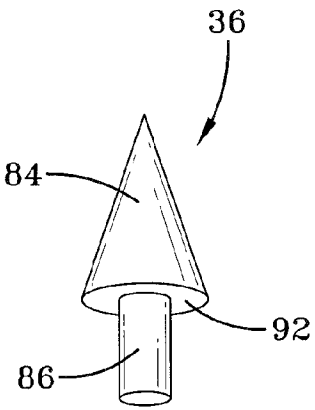
FIG. 15 is a perspective view of an alternative plunger tip.

The toggle 20 may be effective in preventing the plunger 38 from retracting from the tire 12. Alternatives to the toggle 20 may be possible. For example, the toggle 20 may be eliminated and the spiked tip 14 may be replaced with an arrowhead type design. FIG. 15 is a perspective view of the tip of a plunger 36 having an arrowhead type of tip 84. The arrowhead tip 84 may be attached to a reduced diameter portion 86. The bottom surface 92 of the arrowhead tip 84 may provide the surface that bears against the interior of the tire 12 to prevent retraction of the plunger 36. Other variations of the toggle 20 may include a pivoting spike tip.

If a tire 12 is relatively thin-walled, an alternative embodiment of a plunger assembly may include a spike-tipped plunger with a slot therein for a toggle 20. The case, cap, and energetic material described above may not be included. The plunger may be fastened directly to a base, as by welding, for example. Upon penetration of a tire wall, the toggle 20 will rotate and prevent the plunger from being retracted from the tire 12. Further rotation of the tire 12 may cause a plurality of the linked plungers to be pulled around the vehicle's axle and into the vehicle's drive train. By entangling the vehicle's tires, axles, and drive train with the disabling apparatus, the vehicle may be halted well before tire 12 is completely deflated.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A vehicle disabling apparatus located in a path traversed by the vehicle, comprising:

a base having top and bottom strips, a plurality of plunger assemblies each of the plurality of assemblies including a plunger and a toggle operable to pivot inside a vehicle tire and each of the plunger assemblies is fixed to the base wherein the top and bottom assemblies are connected using the plurality of plunger assemblies, and further comprising energetic material disposed adjacent the plunger assemblies and configured to force the plunger assemblies into the vehicle tire.

2. The apparatus of claim 1, wherein the at least one plunger assembly includes a case and a cap, the plunger being disposed in one end of the case and the cap being disposed in another end of the case.

3. The apparatus of claim 2, wherein the plunger includes a spiked tip.

4. The apparatus of claim 2, wherein the at least one plunger assembly includes a shear pin that passes through the case and the plunger.

5. The apparatus of claim 2, wherein the plunger assembly includes a stop pin disposed in the plunger and in a slot in the case.

6. The apparatus of claim 2, wherein the energetic material is disposed in the cap.

7. The apparatus of claim 1, wherein the toggle is rotatably fixed to the plunger.

8. The apparatus of claim 1, further comprising a base, wherein the at least one plunger assembly is fixed to the base.

9. The apparatus of claim 8, wherein the base comprises top and bottom strips having openings at each end.

10. The apparatus of claim 9, wherein the at least one plunger assembly comprises a plurality of plunger assemblies.

11. The apparatus of claim 10, wherein the top and bottom strips are connected using the plurality of plunger assemblies.

12. The apparatus of claim 11, wherein the bottom strips include stop members that limit an angle between the top and bottom strips.

13. The apparatus of claim 11, wherein each plunger assembly includes a cap and a case and further wherein the cap is disposed in an opening in a bottom strip and an opening in a top strip and in a bottom of the case.

14. The apparatus of claim 13, wherein the cap is threaded into the bottom of the case.

15. The apparatus of claim 1, wherein the plunger includes an arrowhead type tip.

16. A method of disabling a vehicle having a tire, comprising:

providing the apparatus of claim 1 in a path of travel of the vehicle; and pivoting the toggle inside the tire.

17. The method of claim 16, wherein the apparatus comprises energetic material disposed adjacent the plunger, the method further comprising, using the tire to move the plunger and thereby activate the energetic material; and moving the plunger into the tire using gas produced by the energetic material.

18. The method of claim 17, wherein using the tire to move the plunger includes shearing a shear pin.

19. The method of claim 17, wherein the plunger is disposed in a case and further wherein moving the plunger into the tire includes limiting the movement of the plunger with respect to the case.

* * * * *